US005207145A

United States Patent [19]

Kemner

[11] Patent Number: 5,207,145

[45] Date of Patent: May 4, 1993

[54] WORK CYLINDER, SUCH AS THE WORK CYLINDER OF A RODLESS PISTON CYLINDER

[75] Inventor: Axel Kemner, Isernhagen, Fed. Rep. of Germany

[73] Assignee: Mannesmann Aktiengesellschaft, Düsseldorf, Fed. Rep. of Germany

[21] Appl. No.: 803,286

[22] Filed: Dec. 4, 1991

[30] Foreign Application Priority Data

Dec. 5, 1990 [DE] Fed. Rep. of Germany ..... 4039172

[51] Int. Cl.[5] ..... F01B 11/02

[52] U.S. Cl. ..... 92/85 B; 92/177; 92/137; 91/405

[58] Field of Search ..... 92/85 R, 85 B, 177, 92/137; 91/22, 25, 26, 31, 405, 406, 408, 409

[56] References Cited

U.S. PATENT DOCUMENTS

| | | | |
|---|---|---|---|
| 2,935,047 | 5/1960 | Ortman et al. | 91/408 |
| 3,027,877 | 4/1962 | Lansky | 91/26 |
| 3,267,815 | 8/1966 | Ortman et al. | 92/85 B |
| 3,418,888 | 12/1968 | Mercier | 91/26 |
| 3,450,003 | 6/1969 | Nightingale | 91/26 |
| 3,805,672 | 4/1974 | Pekrul | 92/85 B |
| 4,982,652 | 1/1991 | Blatt | 92/85 B |

FOREIGN PATENT DOCUMENTS

| | | | |
|---|---|---|---|
| 7931561 | 11/1979 | Fed. Rep. of Germany . | |
| 544229 | 12/1973 | Switzerland . | |
| 1109088 | 4/1968 | United Kingdom | 91/26 |

OTHER PUBLICATIONS

Der Maschinenbau 1964, p. 67.

"Der pneumatische Linear-Transporter" brochure by Südtechnik not dated.

"Normzylinder Durchmesser 10–25 mm" brochure by Mannesmann Rexroth Pneumatik, Oct. 1990.

*Primary Examiner*—Thomas E. Denion

*Attorney, Agent, or Firm*—Nils H. Ljungman and Associates

[57] ABSTRACT

This invention relates to a work cylinder having damping stops for limiting movement of the piston within the cylinder, the cylinder having cylinder covers for closing the ends of the cylinder, whereby the damping stops are positioned and retained substantially between the cylinder covers and the cylinder walls when the cylinder covers are fastened to the cylinder.

5 Claims, 7 Drawing Sheets

WORK CYLINDER, SUCH AS THE WORK CYLINDER OF A RODLESS PISTON CYLINDER

BACKGROUND OF THE INVENTION

1. Field of the Invention

This invention relates to a work cylinder having a damping movement limit. Such a work cylinder may be used, for example, as the work cylinder of a rodless piston cylinder. Such a work cylinder typically has cylinder covers closing off the ends of the cylinder, and the piston is generally slidable within the cylinder, with the amount of movement within the cylinder being limited by position stops or limits. These stops or limits can be damping stops or limits which also absorb some of the shock produced by contact of the piston with the stop or limit.

2. Background Information

The prior art includes numerous examples of pneumatic work cylinders which have damping limits for damping and limiting movement of the piston within the cylinder. Essentially, a distinction can be made between two different types of damping. The first type of damping is typically referred to as dynamic damping, and the second type as impact damping.

In dynamic damping, the piston movement is damped as a function of its velocity, several millimeters, or even centimeters before it reaches the limit stop point. Such dynamic damping can be achieved by having a damping piston, which can be located either on the cylinder cover or directly on the work piston itself, penetrate, at the end of the work stroke, into a compression chamber provided with a sealing ring. Such a compression chamber is typically forcibly vented, but only after the pressure build up within the chamber reaches a predetermined pressure limit.

Such a damping limit is described in the advertising brochure published by the firm of Miller Fluid Power (File 8625 018909). In the Miller cylinder, a stationary plunger located in the limit stop, penetrates into a corresponding recess in the work piston. The recess has a corresponding sealing ring, and as the piston penetrates into the recess, the volume of the recess is compressed, so that a deceleration of the piston takes place as described above. A disadvantage of this version of the prior art is that the damping plunger must be attached to the cylinder cover by appropriate fastening elements. During the fastening, close attention must be paid to a precise positioning of the damping plunger since the work piston determines the precise position of the damping plunger in the vicinity of the limit stop. This type of precise positioning assembly generally increases the expense and complexity of assembly and installation.

The second possibility for limit damping is typically referred to as impact damping. One version of this type of damping limit is described in the advertising brochure published by the firm of Südtechnik, Maroldt & Co. KG (Publication No. 7812). The impact damping in this prior art device, called a "Mardrive" Pneumatic Linear Transporter, is accomplished by means of bumpers disposed on the end surfaces of the cylinder. A disadvantage of this arrangement, like the previous arrangement of Miller, is that the damping stops called bumpers must also be fastened in place with fastening elements during assembly and installation.

OBJECT OF THE INVENTION

The object of the invention is therefore to provide an improved work cylinder having damping movement limits so that the fastening and fixing of the damping limits can be accomplished in a manner which is as simple and easy to perform as possible.

SUMMARY OF THE INVENTION

This object is achieved, on the basis of a work cylinder of a generic type, by means of a cylinder in which the cylinder covers, on the cylinder chamber sides, preferably have a recess which extends in the longitudinal direction of the cylinder. The cross section contour of the recess preferably projects at least partly beyond the cross section contour of the cylinder interior. The damping stop can then be formed as a single piece which preferably has two adjacent segments, one of which segments preferably has the cross section contour of the recess and is located within the recess, and the other of which preferably has the cross section contour of the cylinder interior and projects into the cylinder interior.

The advantage of the present invention lies in the simplification of the assembly process. As a result of the coordination of the cross section of the interior of the cylinder with the dimensions of the recesses in the cylinder covers, and in combination with the correspondingly shaped damping stops, simple, correct and secure assembly becomes possible. Because the cross section contour of the recess of each cylinder cover can project at least partly beyond the cross section contour of the cylinder interior, and because the damping stop can be in contact in the recess and can project into the cylinder inner chamber, it is possible that, on account of the fastening of the cylinder cover to the cylinder, the damping stops can beheld and fixed in the specified positions by clamping forces alone. The clamping of the damping stop is accomplished essentially in the area in which the cross section contour of the recess and of the damping stop inside it project at least partly beyond the cross section contour of the interior of the cylinder.

In an additional configuration of the present invention, the combination of an oval cylinder chamber and a circular recess provides an additional advantage. In this configuration, it is preferable that the diameter of the circular recess be larger than the minor axis and smaller than the major axis of the oval cross section of the cylinder, so that a portion of the cross section contour of the recess, and thus of the damping stop, projects beyond the cross section contour of the interior of the cylinder. Thus, the desired overlap needed for clamping the stop in place is easily attained. In addition, the present invention can be used to special advantage with work cylinders having a flat design.

A vent hole, preferably located in the damping stop in the longitudinal direction of the cylinder, which vent hole can be connected in a gas tight manner to a forced venting passage located in the cylinder cover, makes possible, in a very simple manner, any forced venting of the interior of the cylinder in the vicinity of the end stop, if such venting is required. In addition, a pin-shaped extension located in the damping stop on the cylinder cover side and the hole located on the bottom of the recess of the cylinder cover make possible a very easy pre-positioning of the damping stop during assembly. Also, the location of a central passage hole in each damping stop, when a work piston is used in combination with a damping piston, makes possible a combination of dynamic damping and impact damping, and the fabrication of the damping stop from a thermoplastic material has the advantage that the residual energy from the piston movement can be absorbed in a very simple manner.

One aspect of the invention resides broadly in a work cylinder for a rodless cylinder or the like, the work cylinder having a longitudinal axis, a first end and a second end spaced apart from the first end. The work cylinder comprising a cylinder, the cylinder defining a cylinder chamber therein, a piston for being movably disposed within the cylinder in the cylinder chamber for movement within the cylinder chamber along the longitudinal axis, end covers for being disposed adjacent the first and second ends of the cylinder, damping stops for limiting the movement of the piston within the chamber upon contact of the piston with the damping stops, and damping the contact of the piston with the damping stops. The damping stops are for being retained between the cylinder and the end covers upon assembly of the cylinder with the end covers.

BRIEF DESCRIPTION OF THE DRAWINGS

The present invention is described in greater detail below and is illustrated in the accompanying drawings, in which.

DESCRIPTION OF THE PREFERRED EMBODIMENTS

Figure 1:
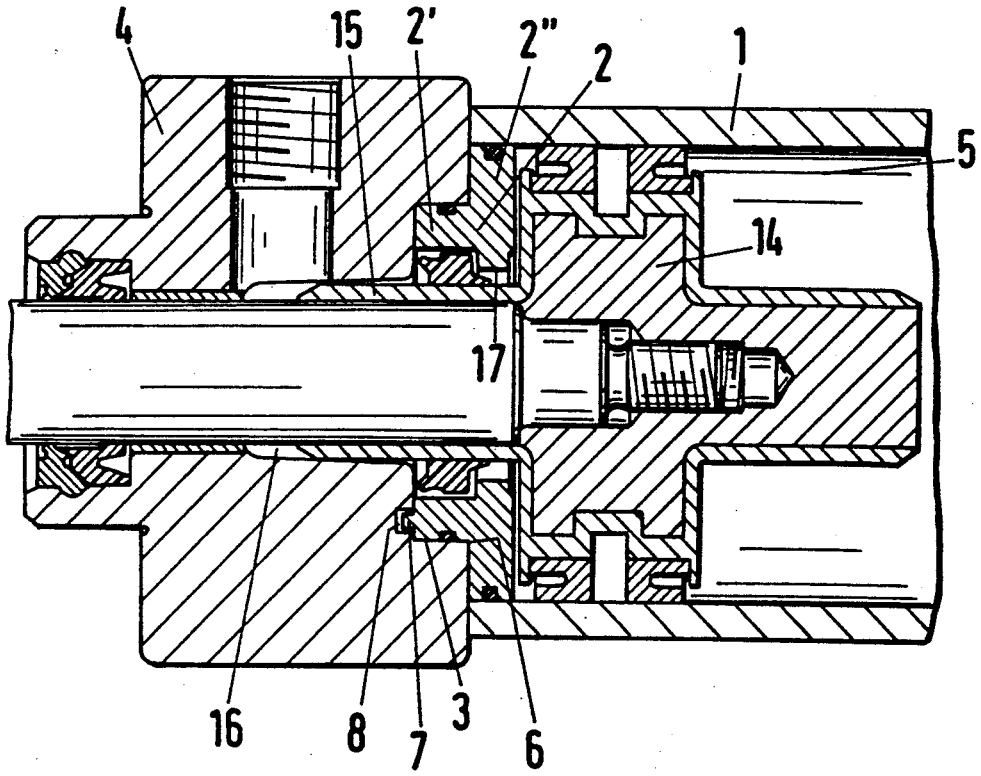
FIG. 1 shows a work cylinder in longitudinal section.
Figure 1A:
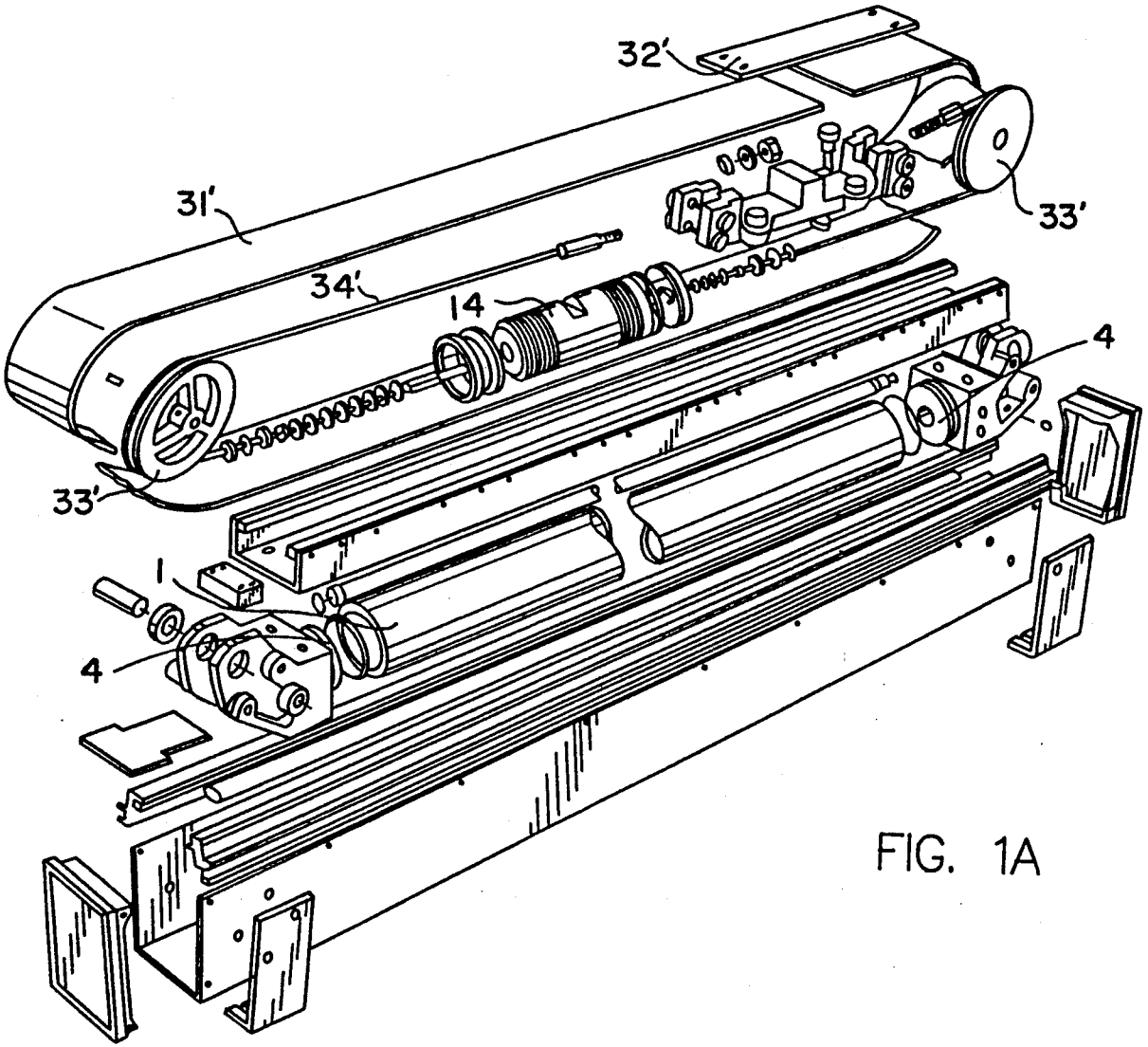
FIG. 1*a* shows an exploded view of a tension band cylinder for which the damping position limits of the present invention can be used.

FIG. 1*a* shows an example of a rodless cylinder which comprises a cylinder 1 having end covers 4, a piston 14, deflecting rollers or pulleys 33', a belt 31, a cable 34', and a force drive 32'. Cable 34' can be attached to piston 14 and runs over pulleys 33', which pulleys 33' contact belt 31'. Belt 31' can be connected to force drive 32', so that the transfer of force by piston 14 is through cable 34' to pulleys 33', and then from the pulleys 33' through belt 31' to force drive 32'.

FIG. 1 shows a detail of a longitudinal section through a portion of the work cylinder. The drawing essentially shows only one of the ends of the work cylinder since the entire work cylinder is preferably symmetrical. The damping stop 2, preferably has a segment 2' for being disposed toward the cylinder cover 4. This segment 2' preferably lies entirely within the recess 3 of the cylinder cover 4. The damping stop 2 also preferably has a second segment 2" which projects into the cylinder interior 5. This second segment 2" is preferably in contact with the peripheral edge of the interior 5 of the cylinder 1. The entire damping stop 2 can preferably be manufactured as a single piece, and the transition between the first and second segments of the damping stop 2 can be stepped. Because of such a stepped transition, the cylinder cover 4 need not be machined in the transition to the cylinder interior along the edge 6.

The damping stop 2 also preferably has a pin-shaped extension 7 which preferably projects into an opening 8 provided on the bottom of the recess 3 of the cylinder cover 4. The fitting of this extension 7 into the opening 8 can secure the position of the stop 2 during assembly of the work cylinder. The pin-shaped extension 7 can also be integral with the one-piece damping stop 2, thereby allowing the entire damping stop 2 to comprises a single piece. Thus, since the stop 2 can be made from a single piece, and is held in place by clamping of the cylinder 1 to the end cap 4, there need not be any additional steps in putting together and installing the damping stop.

The work piston 14 can preferably be equipped with additional damping pistons 15 which provide additional dynamic damping at the corresponding end stop. These additional damping pistons 15 preferably extend through the passage hole 17 of the damping stop 2 into a compression volume 16. This compression volume 16 can be connected to some type of forced venting means if such a forced venting is necessary or desirable.

Figure 2:
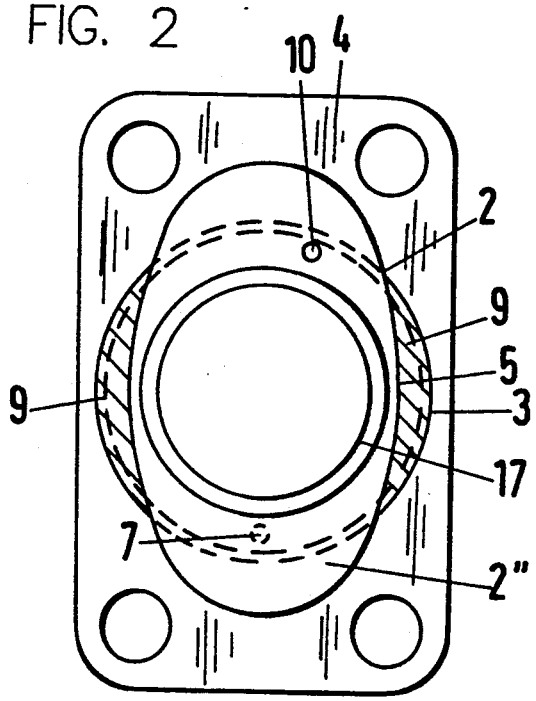
FIG. 2 shows, from a cylinder side view, a cylinder cover for the ends of the cylinder.

FIG. 2 shows the cylinder cover 4 in a view from the cylinder side. The damping stop 2 is shown positioned within the recess 3 in the manner described in FIG. 1. The particularly favorable configuration of the cross section of the recess 3 in the cylinder cover 4 and the cross section of the interior 5 of the cylinder are clearly shown. The preferably oval cross section of the second segment 2" of the damping stop 2 here also characterizes the cross section of the interior of the cylinder. With the damping stop 2 disposed as shown in the cover 4, after assembly of the cover 4 to the cylinder tube 1, the cylinder tube 1 will preferably press and retain the damping stop 2 within the recess 3. The stop 2 is retained in the recess 3 by the cylinder tube 1 pressing against the stop 2 in the area in which the cross section contour of the recess 3 and of the segment 2' of the damping stop 2 lying in it, project beyond the cross section contour of the cylinder interior 5 and thus beyond the second segment 2" of the damping stop 2. This area is shown hatched in FIG. 2 and can be designated as the press surface 9. In other words, during assembly of the cylinder, the cylinder tube 1 preferably presses against the press surface 9 and anchors the damping stop 2 in the position shown. The hole 10, if needed for forced venting, can preferably run parallel to the longitudinal direction of the cylinder through the damping stop 2.

Figure 3:
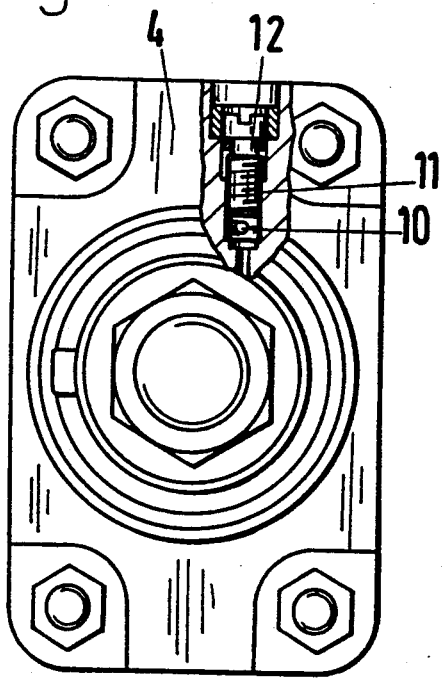
FIG. 3 shows, from an external viewpoint, the cylinder cover, with a cut-away section showing a representation of a forced venting passage.

FIG. 3 shows the cylinder cover 4 from an external perspective. In addition, FIG. 3 also shows a cut-away of a forced venting valve, in a vertical projection. The hole 10 in the cylinder cover 4 preferably empties into a forced venting passage 11 running perpendicular to hole 10. This passage 11 can preferably be closed off by means of a throttle screw 12. The corresponding pressure at which the forced venting is to take place can then be adjusted by means of this throttle screw 12 to alter the damping characteristics of the work cylinder.

If a circular cylinder were to be used, it would still be conceivable that the segment of the damping stop projecting into the cylinder chamber can describe a correspondingly circular cross section contour which, according to the invention, must have a diameter smaller than the diameter of the recess or of the segment of the damping stop projecting into it. The portion of the cylinder-cover-side segment of the damping stop projecting beyond the cross section contour of the cylinder chamber then can still accomplish the purpose described, in that the cylinder tube, during assembly, preferably presses against, and thus fixes the entire damping stop into the cylinder-cover-side segment.

Figure 4:
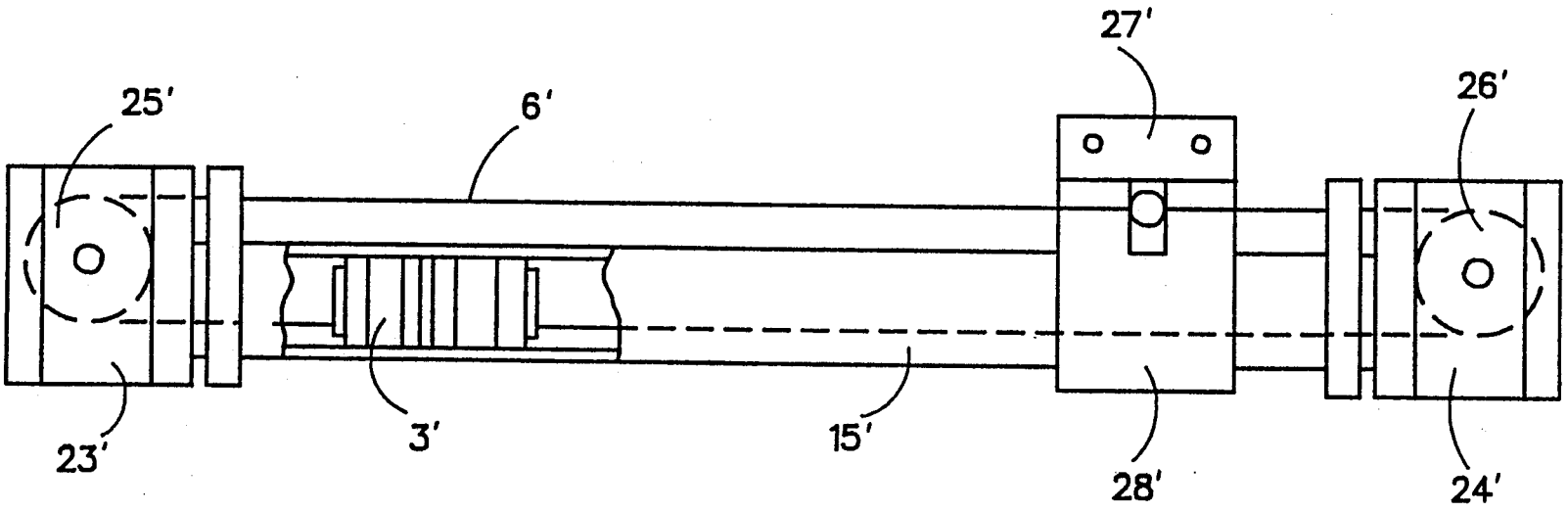
FIG. 4 shows an alternative view of a tension band cylinder.

FIG. 4 shows one example in which the work cylinder according to the present invention is used as a cylinder for a rodless type cylinder. Such a rodless cylinder can consist essentially of a cylinder 15', a piston 1', cylinder heads 23', 24', deflecting rollers 25', 26', a belt 6' attached to piston 1' and running over the deflector rollers 25', 26' and carrying an external force drive 27' which may be integral with guide bushing 28'. The transfer of force is affected by piston 1' through belt 6' to force drive 27'.

Figure 5:
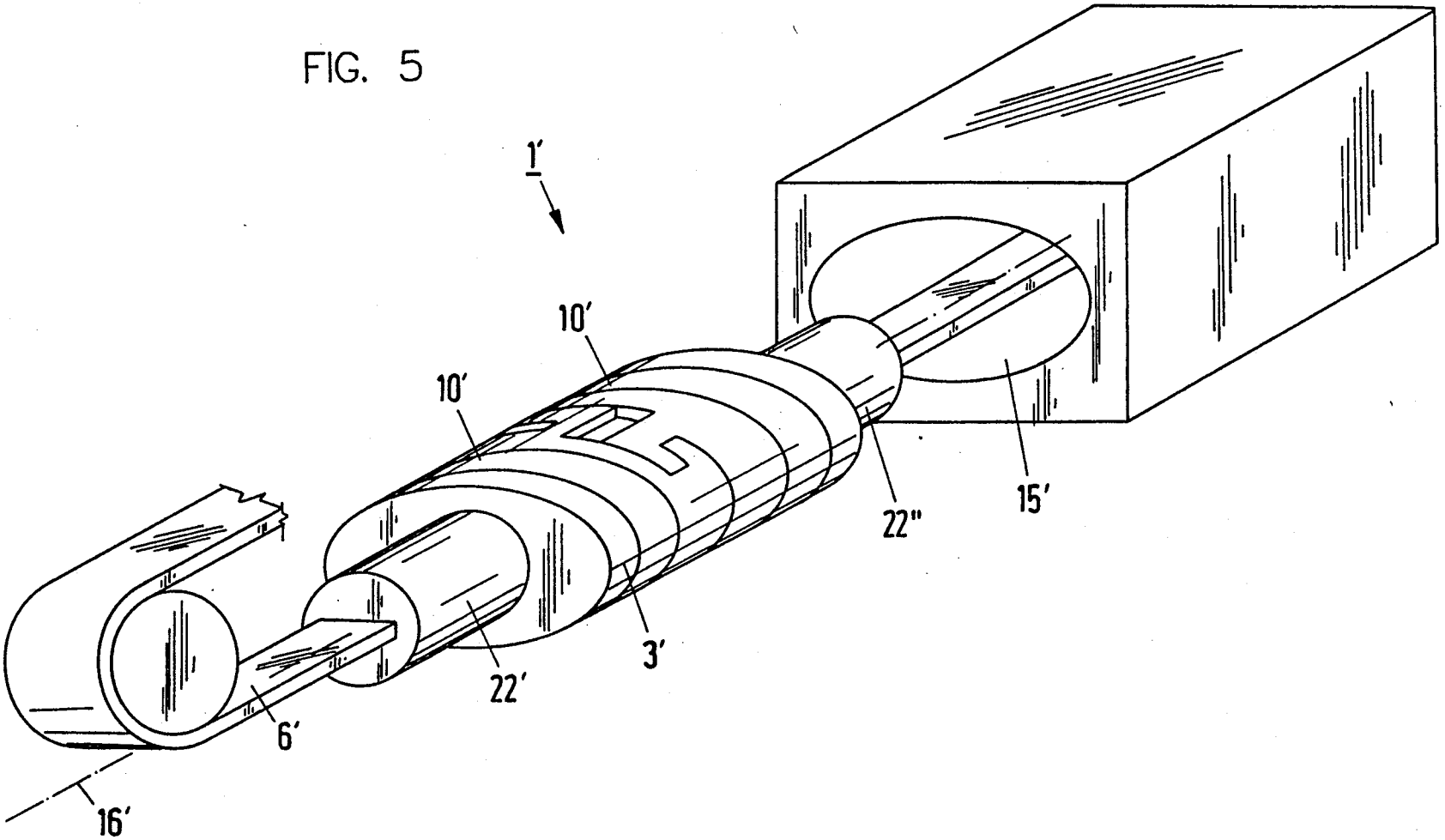
FIG. 5 shows a schematic illustration of a tension band cylinder.

FIG. 5 shows, in perspective view, the entire rodless cylinder 1', which cylinder 1' can have a tension band 6', an oval cylinder chamber 15' and an oval piston 3'. The piston band 6' can be directed along the longitudinal axis 16' running through the center of gravity of the piston 3' into the extensions 22' and 22'' of the piston 3'. In this manner, a uniform load can be applied to the sealing sleeves 10', and the entire piston 3' can be uniformly guided without any tipping forces acting on it. In other words, the tension band 6' can be centered with respect to the cross section contour of the piston 3', so that the piston band 6' can be directed through the center of the piston 3'.

Figure 6:
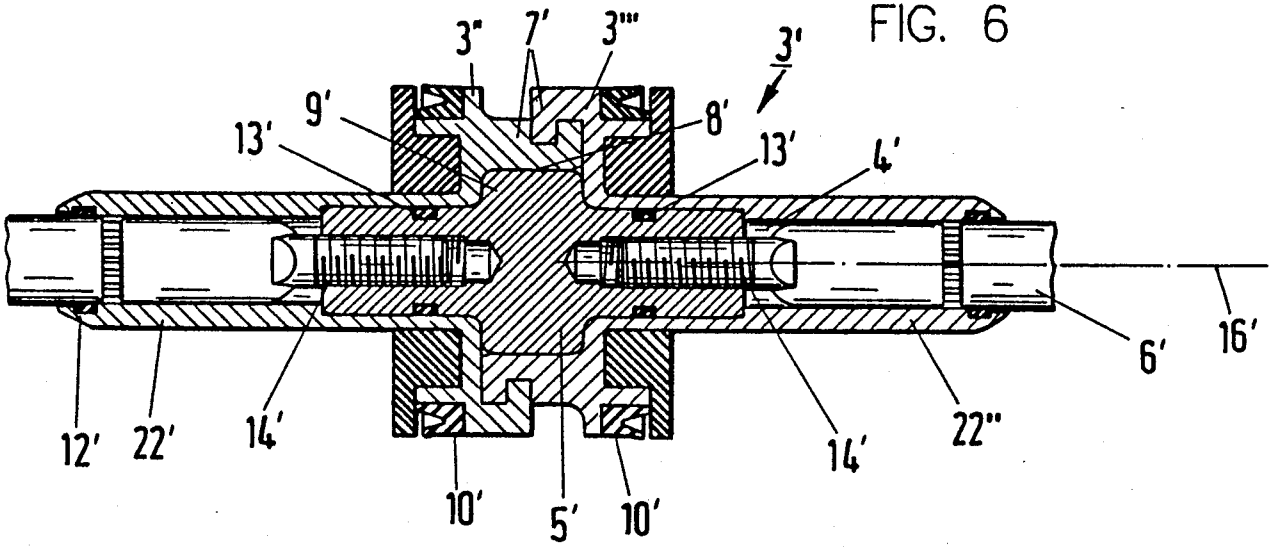
FIG. 6 shows a top view of a partial longitudinal section of a piston of the tension band cylinder.

FIG. 6 shows a detailed cross-section of one type of assembled piston 3', with a holding element 5' and the ends of the tension belt being directed into it. The piston halves 3'', 3''' and the entire piston, when assembled, can occupy the cross section of the cylinder chamber 15' only over a portion of the length of the cylinder chamber 15'. The sealing sleeves 10' can be partly recessed into the outside circumference of the piston 3', so that they have a secure grip. Such a piston configuration can be utilized with the damping stop according to the present invention to limit movement and dampen contact of the piston with the limiting stop. The ends of the piston 3', pointing axially outward, are provided with tubular extensions 22', 22'', and in this manner guide the inserted ends of the tension band 6'. The bayonet connection elements 7, are configured so that they form a type of bayonet connection, in which the piston halves 3'', 3''' are axially brought together and need only be rotated a partial turn. In this case, the piston 3' can have an oval configuration, so that locking elements which stop the bayonet joint formed in this manner, are not necessary, because the oval piston 3' is guided in the oval cylinder chamber 15', so that it is protected against twisting and unlocking. The holding element 5' here is preferably a swivelling part which is rotationally symmetrical in relation to the longitudinal axis 16' of the piston, and which with its thickened segment 9' is positively engaged with the expanded portion 8' of the passage 4' of the piston 3', so that when tensile forces are exerted, the holding element 5' does not move axially relative to the passage 4' of the piston 3'. That is, the holding element 5' can be part of the piston 3' and can move along with the piston 3'. The gaskets 13' preferably seal the passage opening 4' of the piston 3'.

Figure 6A:
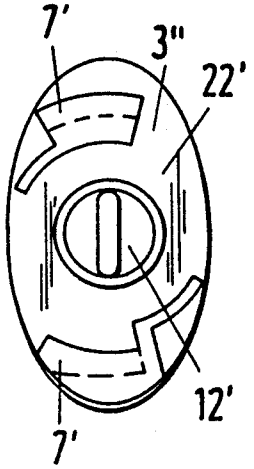
FIG. 6*a* shows a front axial view of a piston half.

FIG. 6a shows the left piston half 3'' with a view of the bayonet connection elements 7'. The oval contour is clearly visible in this figure. The tension band 6' has a rectangular base cross section with rounded narrow sides, and is sealed by a correspondingly O-ring-like gasket 12, The two piston halves 3'', 3''' are here identical in all details, so that for the manufacture of such piston halves using injection molding technology, for example, only a single injection mold is necessary. The cross section contour or the external circumference of the piston can be finally formed by the sealing sleeves 10'.

Figure 7A:
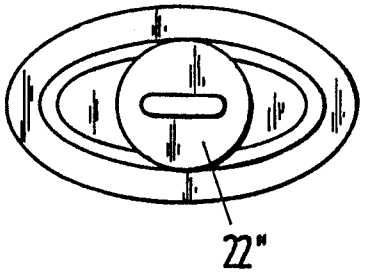
FIG. 7*a* shows a rear axial view of a piston half.
Figure 7:
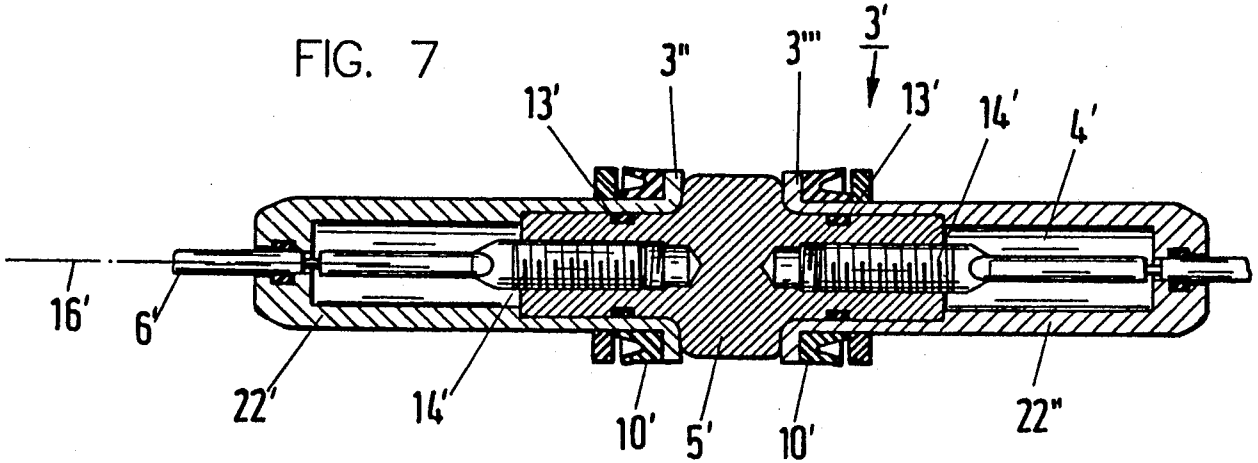
FIG. 7 shows a side view of a partial longitudinal section of a piston.

FIG. 7 shows, in longitudinal section, the piston of FIG. 6 rotated around the longitudinal axis 16' by 90 degrees. FIG. 7a shows the rear view of a piston half in the axial direction. FIG. 7 shows that the bayonet connection elements 7' do not extend over the entire circumferential area of the piston 3', but are located only in the vicinity of the major vertices (See also FIG. 6a). Furthermore, in this illustration, the O-ring configuration of the tension band seal 12' and the cross section contour of the tension band 6' are apparent. If a wire-reinforced plastic tension band is used, this tension band seal 12' is particularly important to prevent a "swelling" of the tension band in the vicinity of the wires. The threaded elements 14' for the attachment of the ends of the tension band to the holding element 5' are also on a common axis, which in this case also forms the central longitudinal or center of gravity axis 16' of the piston.

Figure 8:
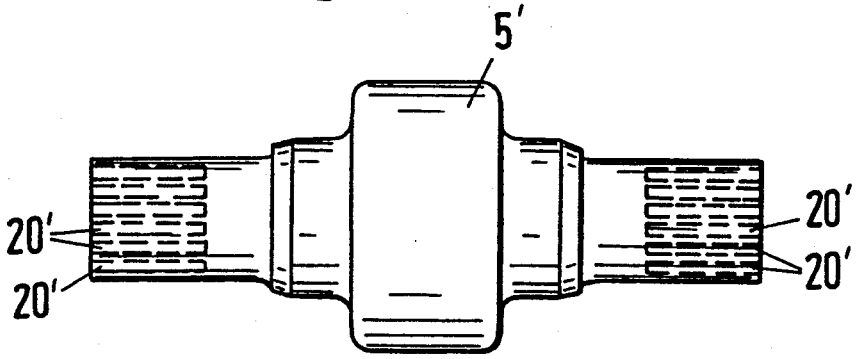
FIG. 8 shows a top view of a holding element with blind holes.

FIG. 8 shows the holding element 5' with the blind holes 20' located on both ends. The wire ends of the tension band, stripped of any plastic coatings which they may have, can be introduced into these blind holes 20' and the ends can then be pressed or crushed to retain the ends in the holes 20'.

Figure 8A:
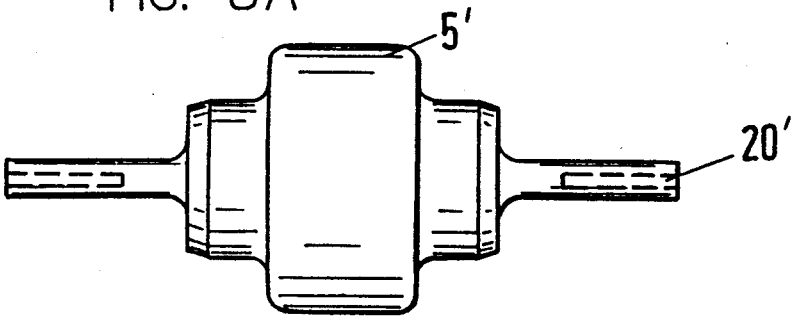
FIG. 8*a* shows a side view of a holding element with blind holes.

FIG. 8a shows FIG. 8 in a side view. It is clear that the ends of the holding element can also be flattened, for example, to retain the wire ends of the tension band.

Figure 9:
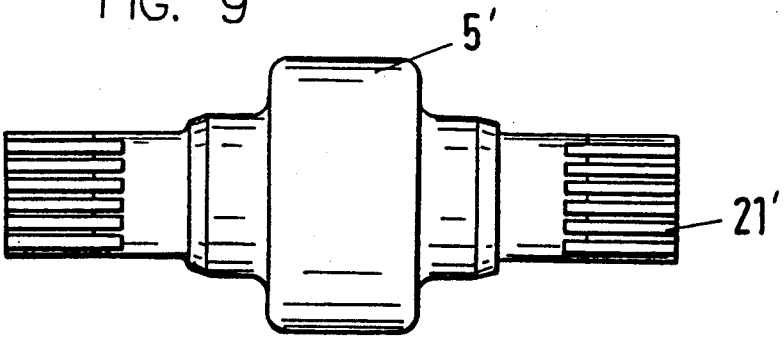
FIG. 9 shows a top view of a holding element with comb-like fastening elements.

FIG. 9 shows the holding element 5' with comb-like fastening elements 21' located at both ends. These comb-like elements 21' can also be pressed or crushed after the introduction of the wire ends of the tension band through the elements of the comb.

Figure 9A:
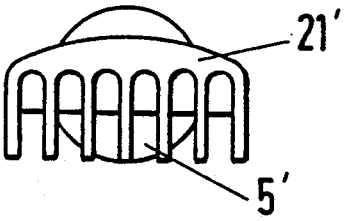
FIG. 9*a* shows a front view of a holding element with comb-like fastening elements.

In FIG. 9a, the comb-like configuration of the fastening element 5' is shown in a front view of FIG. 9.

Overall, this configuration of a cylinder without a piston rod makes possible an assembly process providing rapid and reliable operating conditions. Given the configuration of the piston halves, it is also conceivable that the piston can be a combination of non-identical piston halves. One possibility, for example, would be to shape the end surfaces of the piston halves facing one another in the form of pegs, so that the peg-shaped extensions, when the complementary bayonet connection elements are twisted together, form a joint, continuous cross section contour. That is, rather than each piston half having the same contour as the cylinder, the piston halves would compliment one another such that when combined, the pegs together would form the entire cylinder contour.

The tension means can also be a cable or a chain.

In summary, one feature of the invention resides broadly in a work cylinder with limit position damping, consisting of a cylinder chamber extending in the longitudinal direction, a piston guided so that it moves in the cylinder chamber, and cylinder covers closing the cylinder chamber on the ends, with a damping stop located on the cylinder chamber side of each cylinder cover, characterized by the fact that the cylinder cover 4, on the cylinder chamber side, has a recess 3 extending in the longitudinal direction, whose cross section contour projects at least partly beyond the cross section contour of the cylinder interior 5, that the damping stop 2 is one piece, and is divided into two adjacent segments 2', 2'', such that the one segment 2' has the cross section contour of the recess 3 and is located inside the recess 3, and that the cross section contour of the other segment 2'' has the cross section contour of the cylinder interior 5 and projects into the cylinder interior.

Another feature of the invention resides broadly in a work cylinder with limit position damping characterized by the fact that the cross section contour of the cylinder interior 5 is oval, and the cross section contour of the recess 3 is circular, such that the diameter of the recess 3 is larger than the minor axis and smaller than the major axis of the oval.

Yet another feature of the invention resides broadly in a work cylinder with limit position damping characterized by the fact that the cylinder cover 4 has a forced venting passage 11, which can be closed with a throttle screw 12, and the damping stop 2 has a hole 10 oriented in the longitudinal direction which can be connected in a gas tight manner to the forced venting passage 11.

A further feature of the invention resides broadly in a work cylinder with limit position damping characterized by the fact that the damping stop 2 is provided on the cylinder cover side with a pin-shaped extension 7, which can be inserted into a hole 8 on the bottom of the recess 3 of the cylinder cover 4.

A yet further feature of the invention resides broadly in a work cylinder with limit position damping characterized by the fact that the damping stop 2 is made of a thermoplastic material.

Yet another further feature of the invention resides broadly in a work cylinder characterized by the fact that when a piston is used which is equipped with damping pistons, the damping stop 2 is provided with a passage hole 17 which runs centrally.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Work cylinder with limit position damping, the work cylinder comprising:

a cylinder chamber extending in a longitudinal direction, the cylinder chamber having a first end, a second end and an interior, the interior having a cross section contour;

a piston guided to move in the cylinder chamber in the longitudinal direction;

cylinder covers for being disposed at the ends of the cylinder chamber;

a damping stop for being located on the cylinder chamber side of each cylinder cover;

the cylinder covers, on the cylinder chamber side, having a recess extending in the longitudinal direction, the recess having a cross section contour;

the cross section contour of the recess projecting at least partly beyond the cross section contour of the cylinder interior;

the damping stop comprises one piece having two adjacent segments, wherein a first segment of the two adjacent segments has the cross section contour of the recess and is for being disposed within the recess, and a second segment of the two adjacent segments has the cross section contour of the cylinder interior and is for being disposed within the cylinder interior;

the cross section contour of the cylinder interior is oval, the oval contour having a minor axis and a major axis, and the cross section contour of the recess is circular, the circular contour having a diameter; and the diameter of the recess is larger than the minor axis and smaller than the major axis of the oval.

2. Work cylinder with limit position damping according to claim 1, wherein:

the cylinder cover has a forced venting passage, the forced venting passage comprising a throttle screw for closing the forced venting passage; and the damping stop has a hole oriented in the longitudinal direction, which hole is for being connected in a gas tight manner to the forced venting passage.

3. Work cylinder with limit position damping according to claim 2, wherein:

the recess of the cylinder cover has a bottom, the bottom having an additional recess therein; and the damping stop comprises, on the cylinder cover side, a pin-shaped extension for being inserted into the additional recess on the bottom of the recess of the cylinder cover.

4. Work cylinder with limit position damping according to claim 3, wherein the damping stop comprises a thermoplastic material.

5. Work cylinder with limit position damping according to claim 4, wherein:

the piston comprises at least one additional damping piston disposed thereon; and the damping stop comprises a passage hole which runs centrally through the damping stop, the passage hole being for receipt of the at least one additional damping piston therein.

* * * * *